US006618659B1

(12) United States Patent
Berger et al.

(10) Patent No.: US 6,618,659 B1
(45) Date of Patent: Sep. 9, 2003

(54) BOOM/BUCKET HYDRAULIC FLUID SHARING METHOD

(75) Inventors: John G. Berger, Landisville, PA (US); John R. Haupt, Lititz, PA (US)

(73) Assignee: New Holland North America, Inc., New Holland, PA (US)

( * ) Notice: Subject to any disclaimer, the term of this patent is extended or adjusted under 35 U.S.C. 154(b) by 0 days.

(21) Appl. No.: 10/341,419

(22) Filed: Jan. 14, 2003

(51) Int. Cl.[7] ..... G06G 7/76

(52) U.S. Cl. ..... 701/50; 414/680; 172/12; 60/420; 91/532

(58) Field of Search ..... 701/50; 172/12; 414/680, 695.5, 695.7, 694; 60/420, 426; 91/516, 532

(56) References Cited

U.S. PATENT DOCUMENTS

| | | | |
|---|---|---|---|
| 4,165,613 | A | 8/1979 | Bernhoft et al. |
| 4,723,478 | A | 2/1988 | Diel et al. |
| 4,871,044 | A | 10/1989 | Strosser et al. |
| 5,101,627 | A | 4/1992 | Fujii et al. |
| 5,182,908 | A | 2/1993 | Devier et al. |
| 5,315,828 | A | 5/1994 | Stellwagen et al. |
| 5,347,448 | A | 9/1994 | Nam |
| 5,363,304 | A | 11/1994 | Awano et al. |
| 5,520,087 | A | 5/1996 | Takamura et al. |
| 5,768,973 | A | 6/1998 | Cochran |
| 5,995,893 | A | 11/1999 | Lee et al. |
| 6,233,511 | B1 | 5/2001 | Berger et al. |
| 2001/0007087 | A1 | 7/2001 | Brandt et al. |

*Primary Examiner*—Richard M. Camby
(74) *Attorney, Agent, or Firm*—John William Stader; Rebecca L. Henkel

(57) ABSTRACT

Method of sharing hydraulic fluid, includes: inputting first signal from a first manual control and second signal from a second manual control; sending a first control signal controlling a first valve in response to first signal; sending a second control signal controlling a second valve in response to second signal, wherein the first valve and second valve direct flow through a first sub-circuit and a second sub-circuit, respectively, wherein the first sub-circuit moves a boom arm and the second sub-circuit moves an implement; determining whether the boom arm and implement are in a first, second, third, or fourth condition; modifying at least one of the first and second control signals when the boom arm and implement are in first or second conditions; and controlling the first valve using the unmodified or modified first control signal and controlling the second valve using unmodified or modified second control signal.

8 Claims, 5 Drawing Sheets

BOOM/BUCKET HYDRAULIC FLUID SHARING METHOD

FIELD OF THE INVENTION

The present invention pertains generally to a work vehicle that has a work implement connected to a movable boom assembly, such as a skid steer loader that has a loader bucket connected to a movable boom assembly. In particular, the work implement and movable boom assembly are hydraulically activated and share a common hydraulic circuit. The present invention relates to a work vehicle that includes an improved control system for controlling the work implement and the movable boom assembly in concert so that the common hydraulic circuit is optimally shared by the work implement and movable boom assembly. In this controlled manner, hydraulically activated movement of the work implement and the boom assembly is optimized using a single common hydraulic circuit.

BACKGROUND OF THE INVENTION

Skid steer loaders are work vehicles that include four wheels rotatably mounted to a frame, an engine mounted on the frame and connected by a transmission to rotate at least two wheels, a cab compartment mounted on the frame that includes a seat for an operator, manual controls and a display panel disposed in the cab compartment, a boom assembly rotatably mounted on the frame and connected to a pair of hydraulic boom cylinders for moving the boom assembly, and an implement assembly connected to the boom assembly. Typically, one or more hydraulic cylinders are used to manipulate the implement assembly. Preferably, the implement assembly is a bucket assembly, wherein the implement is a loader bucket and a pair of hydraulic bucket cylinders is used to move the bucket assembly. Other types of work vehicles that are similar to skid steer loaders include tractors and bulldozers.

To operate the hydraulic boom cylinders and the hydraulic implement cylinders, an operator in the cab manipulates either hand or foot manual controls. The skid steer loader, or similar work vehicle, includes an electronic control circuit system that includes an onboard computer, microprocessor, or controller. For the purposes of this disclosure, a computer, microprocessor, or controller are considered to be equivalent and interchangeable elements. The onboard computer operates solenoids of electrohydraulic valves in a common hydraulic circuit that activates both the hydraulic boom and the hydraulic implement cylinders.

U.S. Patent Application Publication US 2001/0007087 A1 to Brandt et al., which is incorporated herein by reference for all it discloses, teaches a computer based control system for a skid steer loader that includes a computer receiving inputs from a control panel, various sensors, hand grip and foot pedal inputs, and a seat bar sensor. The computer generates outputs to hydraulic actuators and associated valves, and to electromechanical devices. Generally, movement of the hand grip and foot pedals generate hand grip and foot pedal inputs that are used by the computer to generate corresponding output signals directing activation of the hydraulic boom and hydraulic implement cylinders to effect movement of the implement assembly and the boom assembly.

The prior art work vehicles have certain drawbacks. First, to minimize space requirements, conserve materials and decrease costs, the hydraulic boom cylinders and the hydraulic implement cylinders are connected together in parallel into a common hydraulic circuit, thereby sharing a common hydraulic fluid supply and reservoir. Consequently, during operation of the work implement assembly and the boom assembly, hydraulic fluid from a hydraulic pump flows to each element in a parallel manner such that fluid flow divides and flows preferentially to the element having the least hydraulic resistance. Thus, there are times when certain movements stress the capacity of the common hydraulic circuit to provide sufficient hydraulic fluid to smoothly power simultaneous movement of the implement assembly and the boom assembly. For example, if the hydraulic sub-circuit activating the boom assembly is commanded by an operator to move very rapidly, most of the available hydraulic fluid will be diverted to the boom assembly leaving very little fluid available to the hydraulic sub-circuit for activating the implement assembly. Such is often the case when an operator directs the boom assembly to extend and lift the implement assembly while simultaneously directing the implement assembly to "dump" the implement.

In this context, to "dump" the implement merely means to rotate the implement, which is pivotally connected to one end of the boom assembly, towards the ground as shown by direction D in FIG. 1. The opposite of dumping the implement is to "curl" the implement, meaning to rotate the implement away from the ground G in the direction C as shown in FIG. 5.

When dumping the implement, hydraulic implement cylinders are activated to extend respective pistons, which requires drawing hydraulic fluid from the common hydraulic circuit. If, at the same time the implement is dumping, the operator directs the boom assembly to rapidly extend, then the hydraulic boom cylinders are activated to extend their respective pistons, which also draw hydraulic fluid from the common hydraulic circuit. As described above, this simultaneous draw on the hydraulic fluid supply of the common hydraulic circuit sometimes results in an insufficient supply of hydraulic fluid to one of the parallel hydraulic sub-circuits. When the boom arm assembly extends while the implement dumps, it is the hydraulic sub-circuit activating the implement assembly that steals hydraulic fluid from the hydraulic sub-circuit activating the boom assembly in a manner that hinders optimal operation of the boom assembly.

On the other hand, an imbalance of hydraulic fluid sometimes occurs when the implement is curling while the boom assembly withdraws from an extended state to a retracted state. In this case, the hydraulic implement cylinders and the hydraulic boom cylinders are simultaneously retracting their respective pistons. Under these circumstances, the hydraulic sub-circuit activating the boom assembly generally acts to steal hydraulic fluid from the sub-circuit activating the implement assembly in a manner that hinders optimal operation of the implement assembly.

Thus, the prior art work vehicles, having a shared common hydraulic circuit for activating both the implement assembly and the boom assembly, have the drawback that activation of one of the hydraulically activated assemblies may compromise the optimal activation of the other hydraulically activated assembly.

Consequently, there is a need for a control system for controlling the activation of the hydraulic implement sub-circuit and the hydraulic boom sub-circuit of the common hydraulic circuit to ensure that hydraulic fluid is shared in a controlled or compensated manner so that neither hydraulic sub-circuit draws hydraulic fluid in a way detrimental to the other hydraulic sub-circuit. In other words, there is a need for a control circuit that automatically compensates for disproportionate fluid flow through two parallel hydraulic sub-circuits to ensure the proper operation of each sub-circuit and the corresponding assembly of the work vehicle it activates.

The present invention provides an improved electronic control system for a work vehicle, or like machine, having a boom assembly and a work implement assembly connected to the boom assembly so that the improved electronic control system of the present invention maintains the benefits of the prior art electronic control systems while overcoming the drawbacks of the prior art control systems.

Accordingly, an object of the present invention is to overcome the disadvantages of the prior art electronic control systems for work vehicles and other like machines.

Another object of the present invention is to provide an electronic control system for work vehicles, and like machines, that automatically compensates for disproportionate fluid flow through two parallel hydraulic sub-circuits to ensure the proper operation of each sub-circuit and the proper movement of the corresponding implement assembly or boom assembly of the work vehicle.

Another object of the present invention is to provide an electronic control system for work vehicles, and like machines, that automatically compensates for disproportionate fluid flow and is practical and cost effective to manufacture.

Another object of the present invention is to provide an electronic control system for work vehicles, and like machines, which automatically compensates for disproportionate fluid flow and is both durable and reliable.

SUMMARY OF THE INVENTION

In accordance with the above objectives, the first preferred machine embodiment of the present invention provides a work vehicle characterized by: (a) a frame; (b) a boom arm assembly connected at one end to the frame; (c) an implement assembly pivotally connected to another end of the boom arm assembly, wherein the implement assembly includes an implement; (d) a first hydraulic implement cylinder connected to the implement assembly and positioned to pivotally rotate the implement relative to the boom arm assembly when a piston of the first hydraulic implement cylinder is extended or retracted, wherein the first hydraulic implement cylinder is connected to a first electrohydraulic valve that activates extension and retraction of the piston of the first implement cylinder by directing hydraulic fluid to the first implement cylinder; (e) a second hydraulic boom cylinder connected to the boom arm assembly and positioned to move the boom arm assembly between a first retracted position and a second extended position when a piston of the second boom cylinder is retracted and extended, respectively, wherein the second hydraulic boom cylinder is connected to a second electrohydraulic valve that activates extension and retraction of the piston of the second hydraulic cylinder by directing hydraulic fluid to the second boom cylinder; (f) a common hydraulic circuit connected to provide hydraulic fluid to the first electrohydraulic valve and to the second electrohydraulic valve, wherein the first electrohydraulic valve is connected in parallel with the second electrohydraulic valve in the common hydraulic circuit; and (g) a controller connected to receive first input signals from a boom manual control sensor and second input signals from an implement manual control sensor, wherein the controller sends a first control signal to activate the first electrohydraulic valve in response to receiving a first input signal and the controller sends a second control signal to activate the second electrohydraulic valve in response to receiving a second input signal, wherein the controller is programmed to modify at least one of the first control signal and the second control signal in accordance with a table-based duty factor when the boom assembly and the implement are operated in a selected condition.

In accordance with a second preferred machine embodiment of the present invention, the first preferred machine embodiment is further modified so the first control signal is modified when the selected condition corresponds to dumping the implement while extending the boom arm assembly, wherein the modified first control signal effects a relative reduction in the hydraulic fluid flow from the first electrohydraulic valve to the first implement cylinder.

In accordance with a third preferred machine embodiment of the present invention, the first preferred machine embodiment is further modified so the second control signal is modified when the selected condition corresponds to curling the implement while retracting the boom arm assembly, wherein the modified second control signal effects a relative reduction in the hydraulic fluid flow from the second electrohydraulic valve to the second boom cylinder.

In accordance with a fourth preferred machine embodiment of the present invention, the second preferred machine embodiment is further modified so the second control signal is modified when the selected condition corresponds to curling the implement while retracting the boom arm assembly, wherein the modified second control signal effects a relative reduction in the hydraulic fluid flow from the second electrohydraulic valve to the second boom cylinder.

In accordance with a first preferred method embodiment of the present invention, a method of sharing hydraulic fluid for activating a boom arm assembly and an implement is characterized by the steps of: (a) inputting a first input signal from a first manual control sensor and a second input signal from a second manual control sensor to a controller connected to receive the first input signal and the second input signal; (b) sending a first control signal to control activation of a first electrohydraulic valve in response to inputting the first input signal into the controller; (d) sending a second control signal to control activation of a second electrohydraulic valve in response to inputting the second input signal into the controller, wherein activation of the first electrohydraulic valve directs hydraulic fluid flow through a first hydraulic sub-circuit and activation of the second electrohydraulic valve directs hydraulic fluid flow through a second hydraulic sub-circuit connected in parallel with the first hydraulic sub-circuit, and wherein hydraulic fluid flow through the first hydraulic sub-circuit effects movement of a boom arm assembly and hydraulic fluid flow through the second hydraulic sub-circuit effects movement of an implement; (e) determining whether the boom arm assembly and the implement are in a first condition, a second condition, a third condition or a fourth condition using the first input signal and the second input signal; (f) modifying at least one of the first control signal and the second control signal when the boom arm assembly and the implement are in the first condition or the second condition; and (g) controlling activation of the first electrohydraulic valve using the first control signal or a modified first control signal and controlling the activation of the second electrohydraulic valve using the second control signal or a modified second control signal, wherein the modified first control signal activates the first electrohydraulic valve to effect a relative reduction in hydraulic fluid flow through the first hydraulic sub-circuit and the modified second control signal activates the second electrohydraulic valve to effect a relative reduction in hydraulic fluid flow through the second hydraulic sub-circuit.

In accordance with a second preferred method embodiment of the present invention, the first preferred method embodiment is further modified so that the first control signal is modified when the first condition corresponds to dumping the implement while extending the boom arm assembly, wherein the modified first control signal effects a relative reduction in hydraulic fluid flow from the first electrohydraulic valve to a first implement cylinder.

In accordance with a third preferred method embodiment of the present invention, the first preferred method embodiment is further modified so that the second control signal is modified when the second condition corresponds to curling the implement while retracting the boom arm assembly, wherein the modified second control signal effects a relative reduction in hydraulic fluid flow from the second electrohydraulic valve to a second boom cylinder.

In accordance with a fourth preferred method embodiment of the present invention, the second preferred method embodiment is further modified so that the second control signal is modified when the second condition corresponds to curling the implement while retracting the boom arm assembly, wherein the modified second control signal effects a relative reduction in hydraulic fluid flow from the second electrohydraulic valve to a second boom cylinder.

Further objects, features and advantages of the present invention will become apparent from the Detailed Description of Preferred Embodiments, which follows, when considered together with the attached drawings.

DETAILED DESCRIPTION IF THE PREFERRED EMBODIMENTS

An embodiment of the work vehicle of the present invention is described with reference to FIGS. 1–5, wherein like numerals indicate like parts. The method of sharing hydraulic fluid for activating a boom arm assembly and an implement in accordance with the present invention is described with reference to FIG. 6. The work vehicle embodiment in accordance with the present invention will be described first to facilitate an easy understanding of the method embodiment of sharing hydraulic fluid for activating the boom arm assembly and the implement of the implement assembly.

Figure 1:
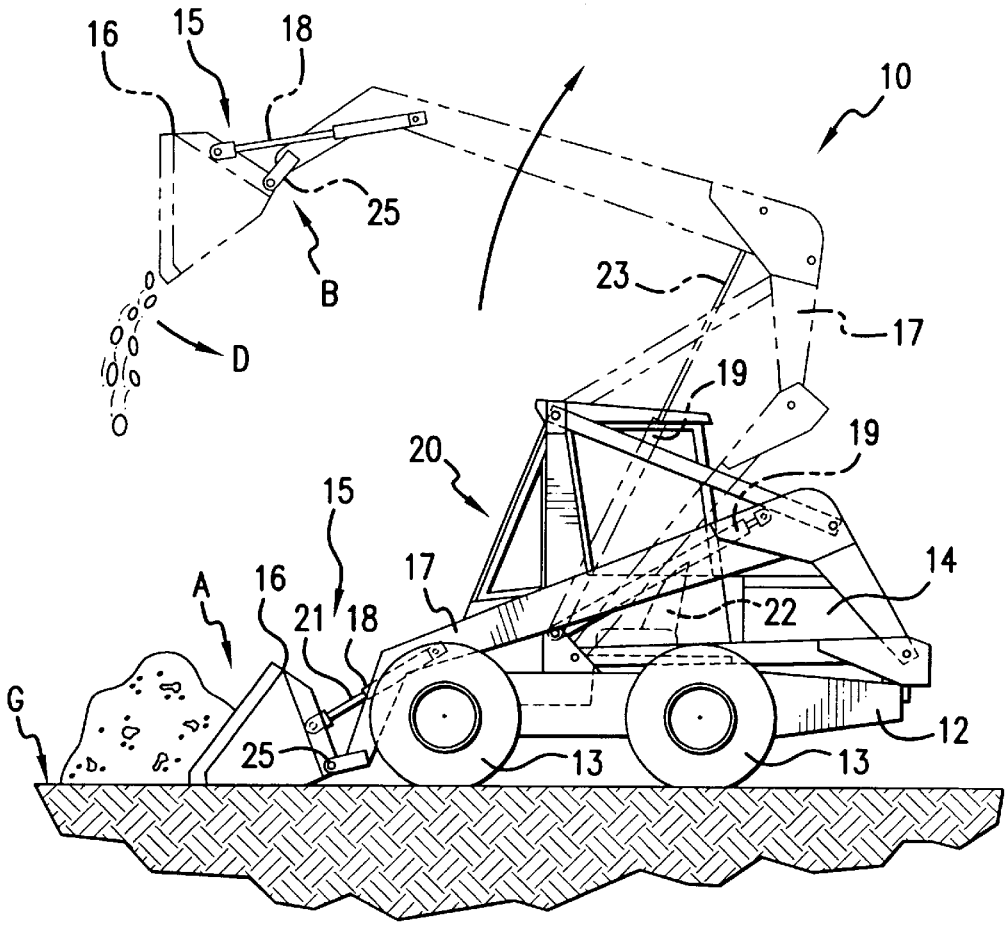
FIG. 1 schematically illustrates a side view of the work vehicle in accordance with the present invention with the boom arm assembly extending while the implement is dumping (shown in phantom).

The machine of the present invention shown in FIG. 1 is a compact work vehicle 10, such as a skid steer loader or other like work vehicle, that includes a cab compartment 20 on the vehicle. Typically, work vehicle 10 includes a body 12 that is mounted on four wheels 13 (only two shown) that are connected to be rotated by a transmission. The transmission is powered by an engine disposed in engine housing 14 located on the body 12. One skilled in the art would realize that the work vehicle 10 could be a tracked vehicle, a vehicle mounted on rails, or could be a machine mounted to a stationary frame without departing from the scope of the present invention.

Work vehicle 10 includes a boom arm assembly 17 that is pivotally connected to the body 12 at one end, and that is pivotally connected at its opposite end to an implement assembly 15 that includes work implement 16, such as a loader bucket, or other useful digging tool. As shown in FIG. 1, boom arm assembly 17 can be raised and lowered between a lower position A and an upper position B (shown in phantom) through a range of motion using hydraulic power provided by a pair of hydraulic boom cylinders 19 of a common hydraulic circuit 50 (shown in FIG. 3) so that the implement 16 can be used to perform its intended function. Implement 16 rotates about pivot connection 25 of the implement assembly 15.

Figure 2:
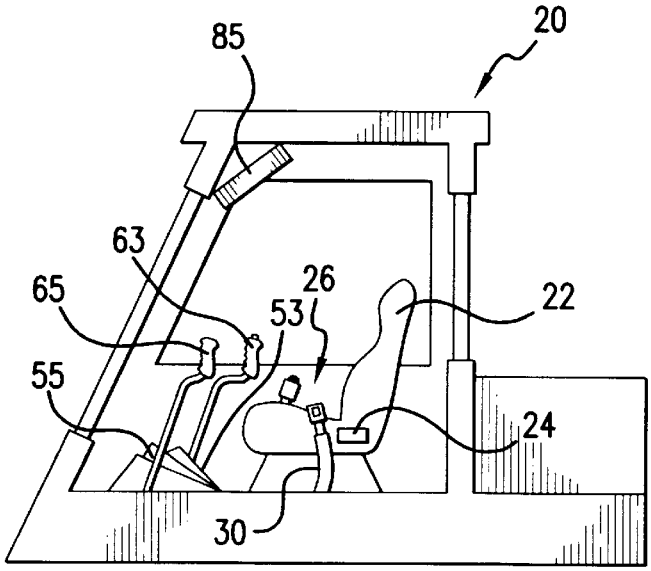
FIG. 2 schematically illustrates a side cut away view of manual controls in the cab of the work vehicle.

As shown in FIG. 2, cab 20 includes pairs of manual controls, such as hand grip controls 63 and 65 and foot pedal controls 53 and 55. An operator sits in seat 22 and operates the manual controls, which are connected to send electronic input signals to a controller 110 as will be explained later.

In the exemplary illustration of FIG. 1, implement 16 is shown as a loader bucket and the work vehicle 10 is shown as a skid steer loader. One skilled in the art would realize that implement 16 could be practiced as a forks pallet, a snow blade, or other useful implement, and the work vehicle 10 could be practiced as a tractor, bulldozer, mini excavator, or other like vehicle, without departing from the spirit and scope of the present invention. Work vehicle 10 is shown digging into material M, wherein the boom assembly 17 is in a lowered position A. Work vehicle 10 is also shown dumping out the material, wherein the boom assembly 17 is at some raised position B. The work vehicle 10 in accordance with the present invention includes an electronic control system 90 integrated with a hydraulic system 50 (aka common hydraulic circuit) that operates to provide improved movement capabilities of the boom arm assembly 17 and the implement 16 as will be described below.

Figure 3:
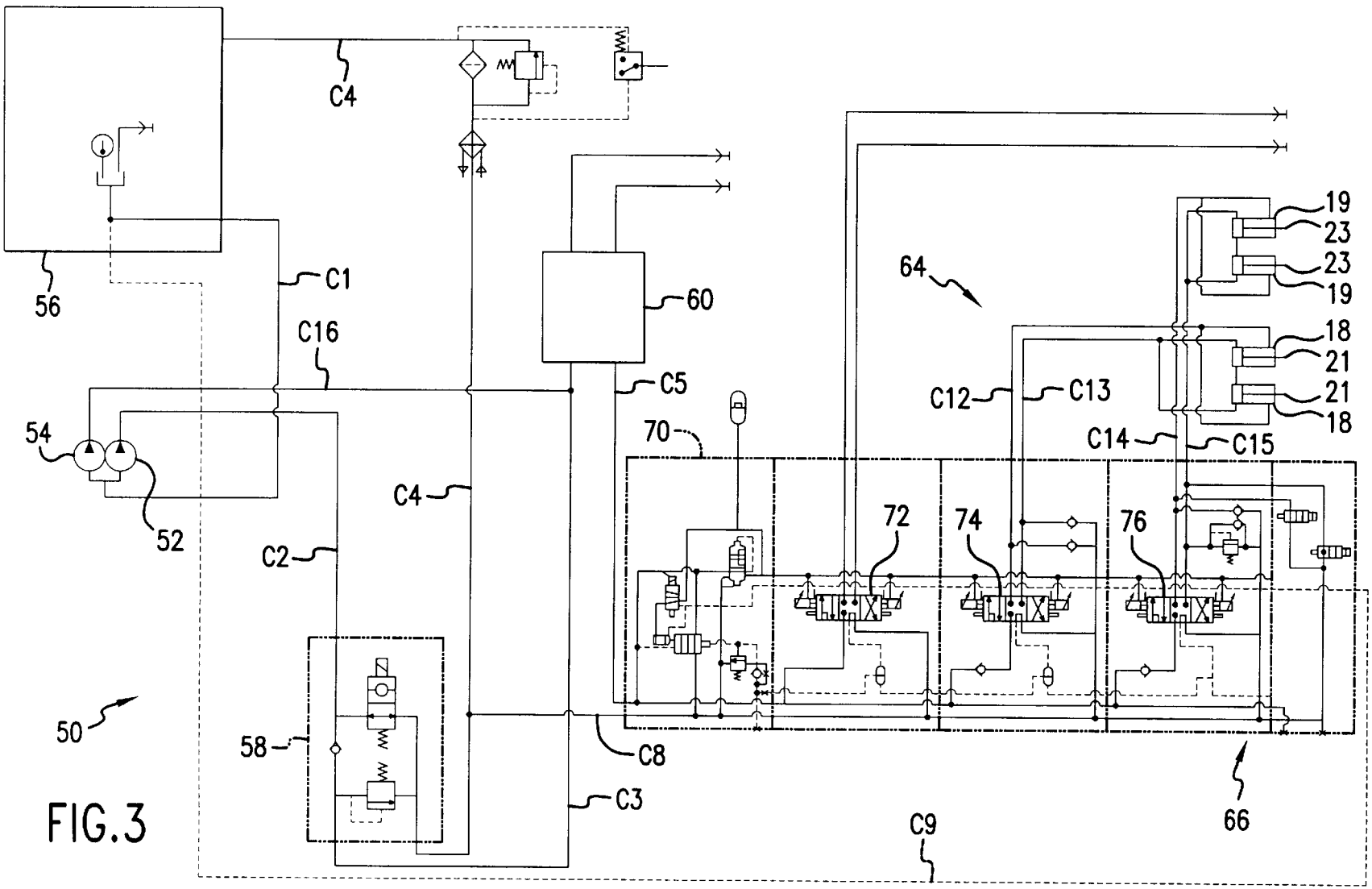
FIG. 3 schematically illustrates the common hydraulic circuit of the work vehicle shown in FIG. 1.
Figure 4:
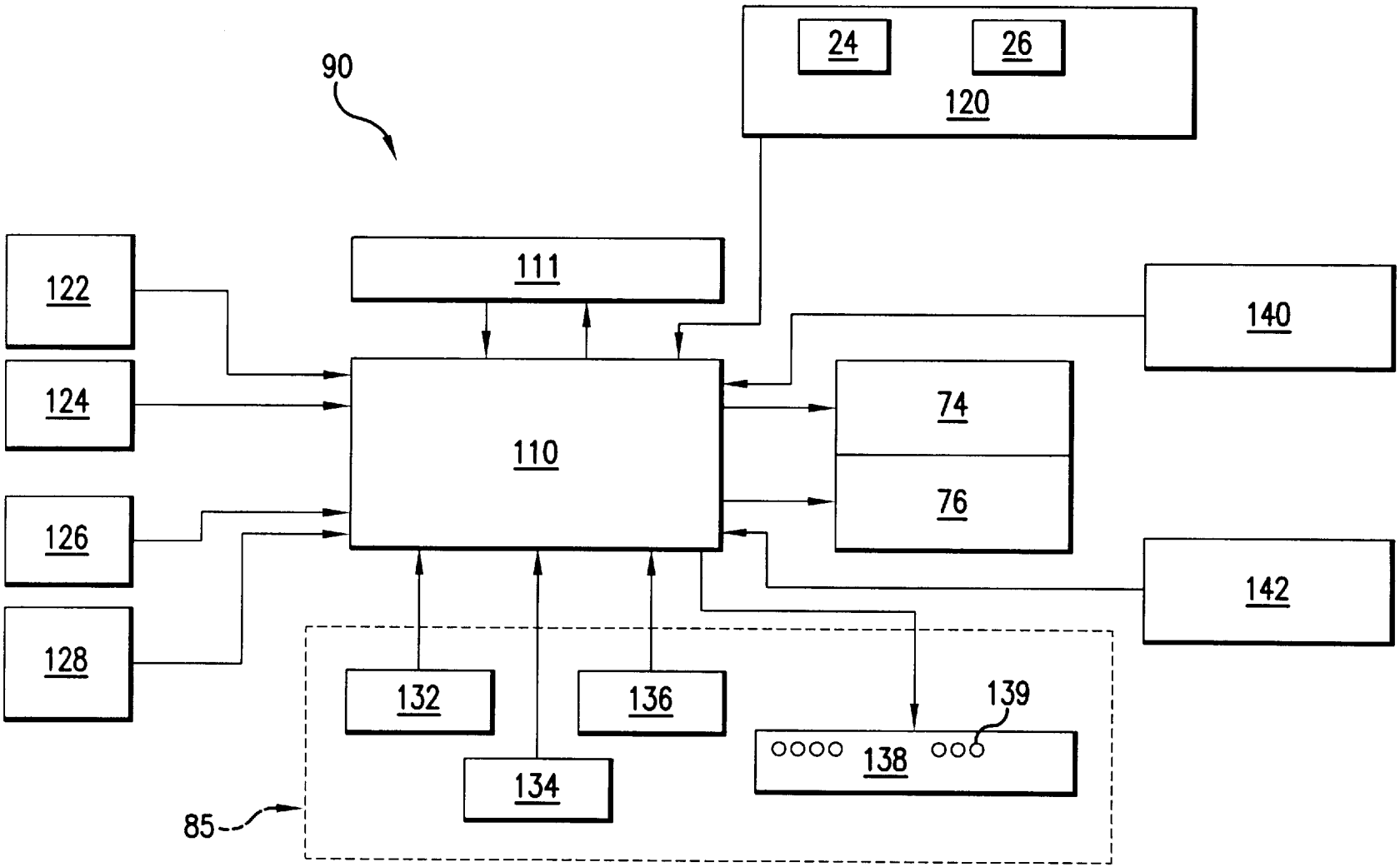
FIG. 4 schematically illustrates the control circuit of the work vehicle shown in FIG. 1.

As evident from FIGS. 3 and 4, hydraulic circuit 50 is connected to be electronically controlled by electronic control circuit 90. Hydraulic circuit 50 is a "common hydraulic circuit" for the work vehicle 10 and includes hydraulic sub-circuits for performing various tasks integrated within the common hydraulic circuit. As will be described, hydraulic sub-circuits 64 and 66 provide hydraulic power for effectuating movement of implement 16 and boom arm assembly 17, respectively. Control circuit 90 generates and sends control signals to electronically operate electrohydraulic valves of sub-circuits 64 and 66 in a manner to effect optimal hydraulic fluid sharing between the implement 16 and the boom arm assembly 17.

Hydraulic circuit 50, as shown in FIG. 3, includes two hydraulic gear pumps 52, 54 connected to draw hydraulic fluid from hydraulic fluid reservoir 56 via hydraulic conduit C1 and to pump hydraulic fluid throughout hydraulic circuit 50. Preferably, pump 52 is a high flow pump and pump 54 is a low flow pump. High flow pump 52 pumps hydraulic fluid via hydraulic fluid conduit C2 to a diverter valve 58. Diverter valve 58 operates to divert hydraulic fluid flow to hydraulic conduit C3 or to hydraulic drain conduit C4. Hydraulic fluid flowing through conduit C3 is used to activate auxiliary valve stack 60, such as would be used to operate an auxiliary hydraulic device (not shown), and/or to activate implement valve slack 70 via hydraulic conduit C5. In the practice of the present invention, auxiliary valve stack 60 is part of an optional auxiliary sub-circuit that can be omitted without departing from the scope and spirit of the present invention. When auxiliary sub-circuit is omitted, conduits C3 and C5 are connected together directly to form one contiguous hydraulic fluid conduit.

In either case, conduit C5 provides hydraulic fluid flow to implement valve stack 70. Implement valve stack 70 incorporates in parallel auxiliary valve 72, implement valve 74, and boom valve 76. Each valve 72, 74, and 76 is an electrohydraulic valve, being an electronically operated, spring return-to-center, hydraulic 4/3 spool valve, or cartridge valve, wherein each valve is electrically connected via solenoids, or digital coils, to electronic control circuit 90. Each electrohydraulic valve 72, 74, and 76 responds to activating electronic signals, either analog or digital depending on the nature of the electrohydraulic valve(i.e., analog signals for spool valves having solenoids or digital signals for cartridge valves having digital coils), generated by the controller 110 of control circuit 90. Electrohydraulic valves 72, 74, and 76 also share a common hydraulic drain conduit C9 that drains to reservoir 56. Furthermore, hydraulic fluid flow to the implement valve stack 70 can return to reservoir 56 via hydraulic fluid conduits C8 and C4.

Activation of electrohydraulic auxiliary valve 72 serves to provide hydraulic fluid to a hydraulic conduit and check valve that can be connected to provide hydraulic fluid for activating an auxiliary device such as an auger drill. Hydraulic fluid drains back from the auxiliary device via a check valve and connected hydraulic conduit to auxiliary valve 72 before draining back to reservoir 56 via conduits C8 and C4. It can be said that auxiliary valve 72 and the auxiliary hydraulic device connected to it make up another auxiliary hydraulic sub-circuit of the common hydraulic circuit 50.

Electrohydraulic implement valve 74, hydraulic conduits C12, C13, and hydraulic implement cylinders 18 form a hydraulic implement sub-circuit 64 for effectuating or activating movement of the implement 16 of implement assembly 15. Activation of implement valve 74 serves to provide hydraulic fluid to hydraulic conduit C12 to activate hydraulic implement cylinders 18. Activation of implement cylinders 18 results in movement of pistons 21, thereby effecting rotational motion of implement 16 about its pivotal connection 25 to boom arm assembly 17. Hydraulic fluid drains back from implement cylinders 18 via hydraulic conduit C13 to implement valve 74 before draining back to reservoir 56 via conduits C8 and C4.

Figure 5:
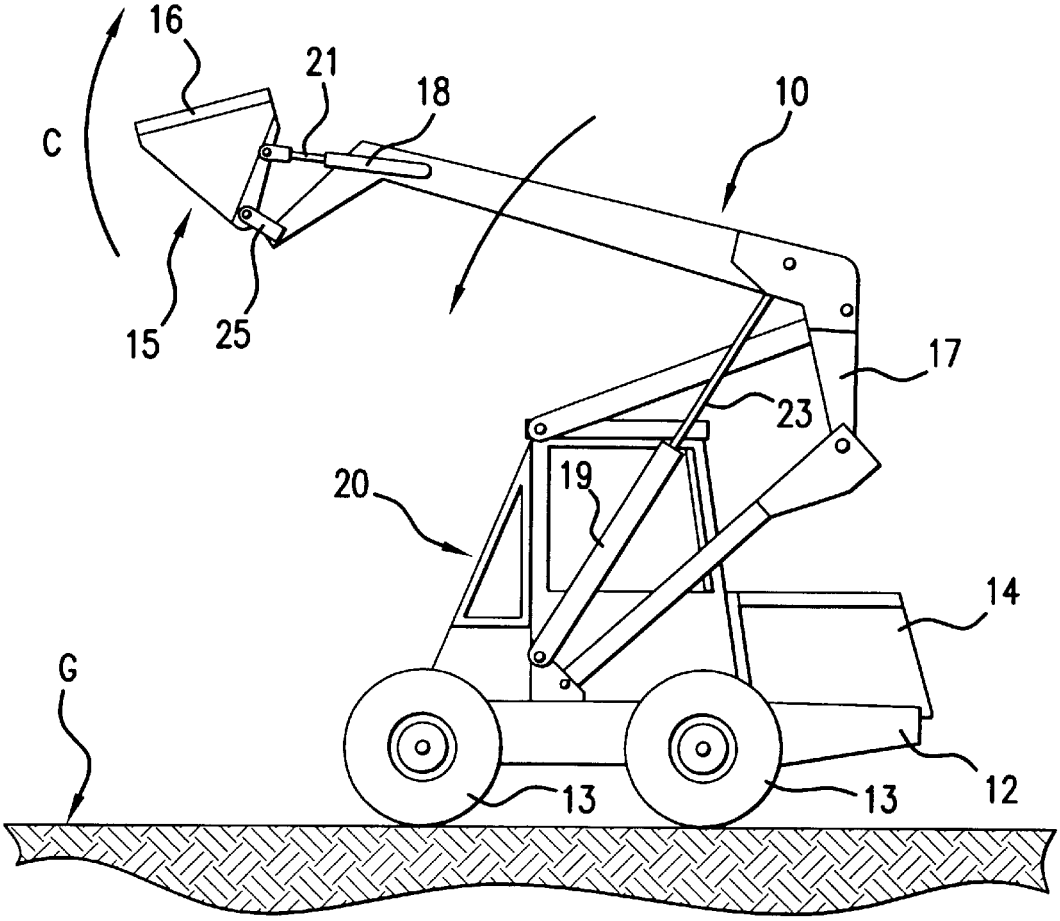
FIG. 5 schematically illustrates a side view of the work vehicle in accordance with the present invention with the boom arm assembly retracting while the implement is curling.

Electrohydraulic boom valve 76, hydraulic conduits C14, C15, and hydraulic boom cylinders 19 form a hydraulic boom sub-circuit 66 for effectuating or activating movement of the boom arm assembly 17. Activation of boom valve 76 serves to provide hydraulic fluid to hydraulic conduit C14 to activate hydraulic boom cylinders 19. Activation of boom cylinders 19 results in movement of pistons 23, thereby effecting motion of boom arm assembly 17 such as shown in FIGS. 1 and 5. Hydraulic fluid drains back from implement cylinders 19 via hydraulic conduit C15 to boom valve 76 before draining back to reservoir 56 via conduits C8 and C4.

Hydraulic circuit 50 also includes low flow pump 54 connected to provide hydraulic fluid to conduit C3 via hydraulic conduit C16. Low flow pump 54 provides much of the hydraulic fluid flow needed to activate auxiliary stack 60 and implement valve stack 70; however, when much higher flows are needed high flow pump 52 is activated to provide the additional hydraulic flow.

Next, the electronic control circuit 90 will be described. FIG. 4 illustrates electrical connections between the various components of the electronic control circuit 90 in accordance with the present invention. Electronic control circuit 90 is carried by the work vehicle 10 and includes an on board controlling microprocessor (also referred to as the "controller") 110 connected to exchange data with a memory storage device 111. Preferably, memory storage device 111 is a non-volatile memory that stores the neutral positions of the operator's manual controls, (i.e., foot control pedals 53, 55 and the hand grip controls 63, 65), look-up reference tables, and other useful data. Although controller 110 and memory storage device 111 are preferably separate structures, controller 110 can be constructed to incorporate the memory storage device without departing from the scope of the invention.

Controller 110 is connected to receive electronic signal inputs from the following devices: operator "seat belt switch and seat switch" circuit 120, right hand stick implement control and position sensor 122, left hand stick boom control and position sensor 124, right foot pedal implement control and position sensor 126, left foot pedal boom control and position sensor 128, hand/foot controls selector switch 132, vehicle tilt sensor 134, special option mode selection switch 136, boom position sensor 140, and implement angle position sensor 142.

For the purpose of this disclosure, the terms "control and position sensor," "control sensor," and "position sensor" are equivalent and interchangeable terms.

Specifically, controller 110 is connected to receive an enabling signal from "seat belt switch and seat switch" circuit 120 that incorporates a seat switch 24 and a seat belt switch 26 as part of seat 22, such as disclosed in U.S. Pat. No. 4,871,044 to Strosser et al, which is incorporated herein by reference for all it discloses. Controller 110 is programmed to await an enabling signal from circuit 120 before being enabled to generate control signals for operating electrohydraulic valves 74, 76 that activate motion of the implement 16 and boom arm assembly 17. Generally, circuit 120 sends the enabling signal to controller 110 when seat switch 24 and seat belt switch 26 are closed, which occurs when an operator is sitting in seat 22 and the male and female ends of the seat belt switch 26 are closed as described by Strosser et al.

Control and position sensors 122, 124, 126, and 128, respectively, sense the position of a manual right hand grip control 63, a manual left hand grip control 65, a manual right foot pedal control 53 and a manual left foot pedal control 55, wherein each sensor sends a respective data input signal to controller 110 indicating the position and rate of change of position of the corresponding manual control from its neutral position. Controller 110 processes data input signals corresponding to the position of the manual right hand grip control 63 or the manual right foot pedal control 53 and generates a first set of control signals that are sent to the electrical solenoids, or digital coils, of hydraulic implement valve 74 to operate hydraulic implement cylinders 18 in proportion to the deviation and rate of deviation of the right sided manual controls from a neutral position. Likewise, controller 110 processes data input signals corresponding to the position of the manual left hand grip control 65 or the manual left foot pedal control 55, and generates a second set of control signals that are sent to the electrical solenoids, or digital coils, of hydraulic boom valve 76 to operate hydraulic boom cylinders 19 in proportion to the deviation and rate of deviation of the left sided manual controls from a neutral position. In other words, the position and rate of change of position of implement 16 and boom arm assembly 17 is determined by the position (displacement) and rate of movement (rate of change of displacement) of the right and left manual controls, respectively, from the neutral position whether the manual controls in use are the manual hand grip controls 63, 65 or the manual foot pedal controls 53, 55.

Controller 110 is connected to receive a selection signal from hand/foot control selector switch 132, wherein the selection signal is used to determine whether controller 110 will be enabled to process manual control input signals received only from the manual hand controls 63, 65 or only from the manual foot pedal controls 53, 55. Thus, electronic control circuit 90 utilizes signal input from either hand control sensors 122, 124 or from foot pedal sensors 126, 128. In other words, at any one time circuit 90 can not utilize signal input from all four sensors 122, 124, 126, and 128. Circuit 90 is constructed to utilize signal inputs from only one pair of these control and position sensors at a time, being either right and left hand control and position sensors 122, 124 or right and left foot pedal control and position sensors 126, 128, so as to generate and send control signals to the solenoids, or digital coils, of electrohydraulic valves 74 and 76 in response to receiving control and position sensor signal input.

Controller 110 may also be connected to receive data signal input from other sensors such as vehicle tilt sensor 134, boom position sensor 140, and implement angle position sensor 142. Controller 110 utilizes these position data signals for various implement 16 and boom assembly 17 automatic positioning functions as may be programmed into the controller. For example, controller 110 can be connected to receive a mode selection signal from special option mode selection switch 136. Special options that can be programmed into controller 110 include an automatic implement leveling function that automatically positions the implement in a desired manner or maintains the position in a desired orientation relative to the ground or the work vehicle. Thus, the mode selection signal would instruct controller 110 to operate in one of several implement self-leveling modes programmed into the controller. Some of the implement self-leveling modes might require data signal input from sensors 134, 140, and/or 142 to operate properly.

Controller 110 may also be connected to send output signals to indicators 139 of a status display 138 of a Total Control System display 85, such as might be located in the cab compartment 20 of the work vehicle 10. Indicators 139 would indicate various conditions of the work vehicle 10, such as the condition of the "seat belt switch and seat switch" circuit 120, any special feature mode in effect, and whether hand or foot pedal manual controls are enabled.

In accordance with the present invention, controller 110 is preprogrammed to generate modified output control signals to automatically adjust for the hydraulic fluid requirements of hydraulic sub-circuits 64 and 66 during certain simultaneous movements of the implement 16 of implement assembly 15 and the boom arm assembly 17. As specifically explained above, sub-circuits 64 and 66 are connected in parallel and must share the hydraulic fluid provided by hydraulic conduit C5. Therefore, during certain operating conditions, hydraulic sub-circuit 64 steals hydraulic fluid from hydraulic sub-circuit 66, and vice versa.

Specifically, when the work vehicle 10 is operated so the boom arm assembly 17 is extending while the implement 16 is dumping (see FIG. 1), the implement sub-circuit 64 steals hydraulic fluid from boom sub-circuit 66 causing a relative shortage of hydraulic fluid to boom sub-circuit 66 and to boom cylinders 19. This condition will be referred to as the "first condition" for convenience sake. As a result, without any compensating procedure, boom assembly 17 may not move and operate properly when the work vehicle is operated in the first condition. In accordance with the present invention, controller 110 is programmed to compensate for this effect by modifying the output signals accordingly to down regulate the operation of the stealing sub-circuit. So, when the work vehicle is operated under the first condition, controller 110 modifies the controlling output signals to implement valve 74 to reduce hydraulic fluid flow to implement cylinders 18 in a relative way. This compensating algorithm programmed into controller 110 recognizes the first condition based upon signal input from the control and position sensors corresponding to one set of enabled paired manual controls, either hand controls 63, 65 or foot pedal controls 53, 55, then generates and sends a modified output control signal to implement valve 74. Controller 110 knows how much to modify the output control signal to implement valve 74 based upon a look-up table stored in the memory storage device 111. This modified output control signal limits the operation of implement valve 74 so as to slow down and limit the flow of hydraulic fluid through implement sub-circuit 64. In this manner, when the work vehicle 10 is operating in the first condition, controller 110 operates to limit the flow of hydraulic fluid to implement sub-circuit 64 so as to prevent the stealing of hydraulic fluid from boom sub-circuit 66.

Another hydraulic fluid stealing situation occurs when the boom arm assembly 17 is retracting while the implement 16 is curling as shown in FIG. 5, which will be referred to as the "second condition" for convenience sake. When work vehicle 10 is operating in the second condition, boom sub-circuit 66 steals hydraulic fluid from implement sub-circuit 64, thereby causing a relative shortage of hydraulic fluid to implement sub-circuit 64 and to implement cylinders 18. In accordance with the present invention, controller 110 is programmed to compensate for this stealing effect occurring under the second condition by modifying the output signals sent to boom valve 76 to reduce hydraulic fluid flow to boom cylinders 19 in a relative way. Thus, the compensating algorithm programmed into controller 110 also recognizes the second condition based upon signal input from the one set of enabled paired manual controls, either hand controls 63, 65 or foot pedal controls 53, 55, then generates and sends a modified output control signal to boom valve 76. Controller 110 knows how much to modify the output control signal to boom valve 76 based upon a look-up table stored in the memory storage device 111. This modified output control signal limits the operation of boom valve 76 so as to slow down and limit the flow of hydraulic fluid through boom sub-circuit 66. In this manner, when the work vehicle 10 is operating in the second condition, controller 110 operates to limit the flow of hydraulic fluid to boom sub-circuit 66 so as to prevent the stealing of hydraulic fluid from implement sub-circuit 64.

For completeness sake, it is mentioned that controller 110 does not need to refer to the look-up tables stored in memory storage device 111 when the work vehicle 10 operates under a condition other than the first condition or the second condition. For example, when the work vehicle 10 is operated so the boom arm assembly 17 is extending while the implement 16 is curling, or when the work vehicle 10 is operated so the boom arm assembly 17 is retracting while the implement 16 is dumping, no appreciable hydraulic stealing occurs between sub-circuits 64 and 66; thus, controller 110 generates and sends output control signals to both boom valve 76 and implement valve 74 without reference to the look-up table in memory storage device 111. Controller 110 also does not need to refer to the look-up table stored in memory storage device 111 when the boom arm assembly 17 is in motion, either extending or retracting, and the implement 16 is not activated (i.e., the implement cylinders 18 are not activated). These three operating conditions are collectively referred to as the "third condition," which includes any condition wherein the boom arm assembly 17 is in operation while the implement 16 is not so there is no stealing of hydraulic fluid between parallel sub-circuits 64 and 66.

Similarly, there is a "fourth condition" wherein only the implement 16 is undergoing rotation about pivot connection 25 due to activation of implement cylinders 18 while boom arm assembly 17 is inactive because the boom cylinders 19 are not activated. When the work vehicle 10 is operating in the fourth condition, controller 110 also does not refer to the look-up table stored in memory storage device 11.

When the work vehicle 10 operates in the third condition, controller 110 generates and sends output control signals to electrohydraulic valves 74 and 76 and the total hydraulic flow in conduit C5 is made available to the boom cylinders 19 as may be required by displacement of a left sided manual boom control 55 or 65. This is done by generating control output signals using the displacement input signals from sensors 128 or 124, respectively, as determined by the controller 110 without reference to the look-up table. Likewise, when the work vehicle 10 operates in the fourth condition, controller 110 generates and sends output control signals to electrohydraulic valves 74 and 76 so the total hydraulic flow in conduit C5 is made available to the implement cylinders 18 as required by displacement of a right sided manual implement control 53 or 63. This is done by generating control output signals using the displacement input signals from sensors 126 or 122, respectively, as determined by the controller 110 without reference to the look-up table.

Figure 6:
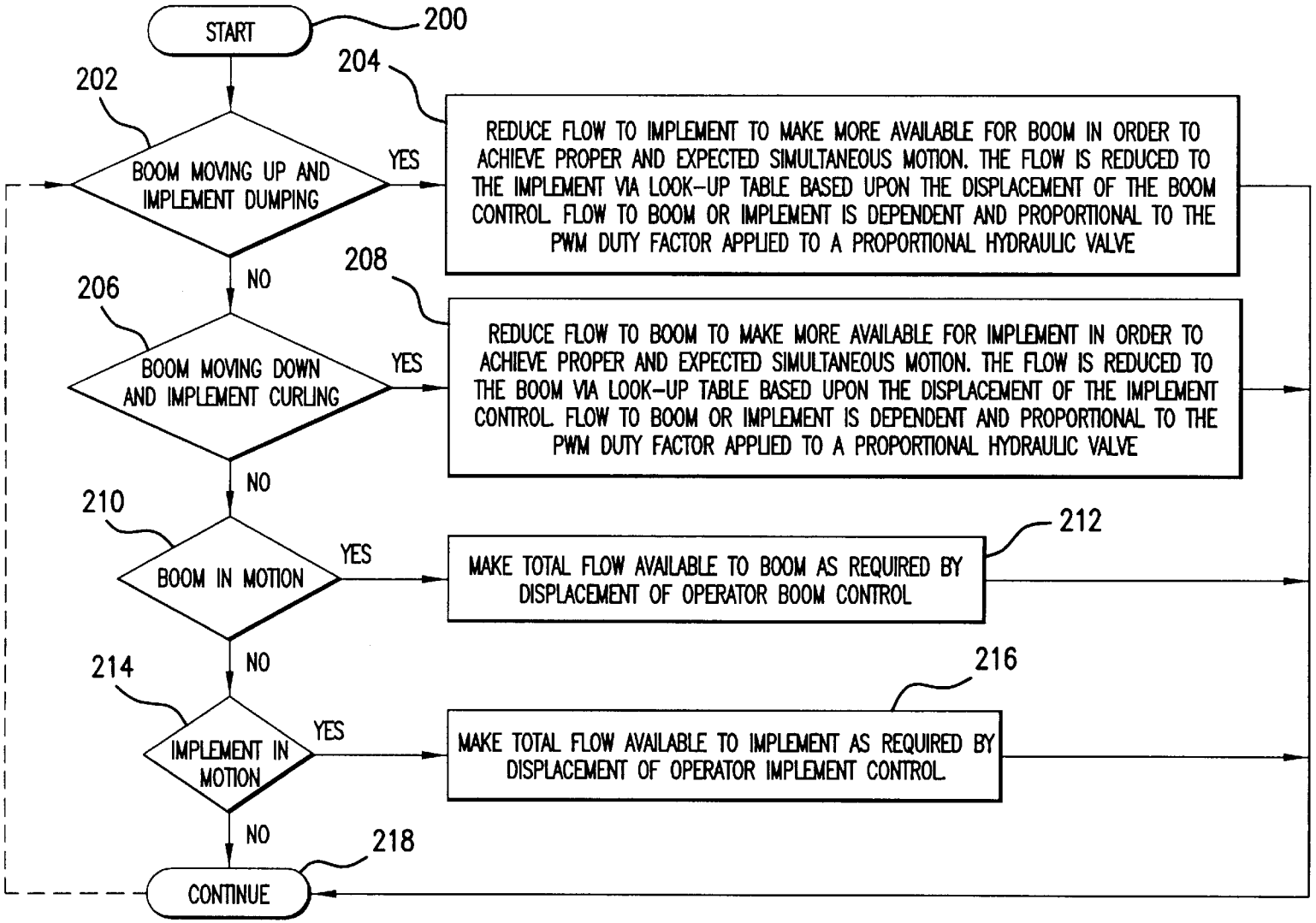
FIG. 6 is a flow diagram of the method of sharing hydraulic fluid for activating a boom arm assembly and an implement in accordance with the present invention.

Having described the machine embodiment in complete detail, the method embodiment in accordance with the present invention will be described with reference to FIG. 6. FIG. 6 outlines the steps in the method of sharing hydraulic fluid for activating a boom arm assembly and an implement in accordance with the present invention.

Step 200 is the start of the method, wherein the work vehicle 10 is in operation so that the boom arm assembly 17 and the implement 16 of the implement assembly 15 are enabled and controller 110 is awaiting or receiving sensor input from the enabled pair of manual controls that will indicate that the manual controls have been displaced from a neutral position.

Step 202 is the step wherein controller 110 has received sensor input signals from position sensors on a pair of right and left manual controls (i.e., either manual hand controls 63, 65, or manual foot pedal controls 53, 55) and determines if the work vehicle 10 is operating in the first condition (i.e., the boom assembly is extending and the implement is dumping). If controller 110 determines that the work vehicle 10 is operating in the first condition, then the method moves on to step 204; otherwise, the method moves on to step 206.

In step 204, the controller 110 accesses and retrieves information from the look-up table stored in memory storage device 111 and uses this information to modify the calculation and generation of output control signals sent to operate implement valve 74 so as to reduce the flow of hydraulic fluid to the implement cylinders 18 of the implement sub-circuit 64. The look-up table lists Pulse Width Modulation ("PWM") duty factors that adjust, or down regulate, the output control signals to the implement valve 74, wherein hydraulic fluid flow to the implement 16 of implement assembly 15 is proportional to the PWM duty factor applied to the implement valve 74. In this manner, more hydraulic fluid flow is made available to the boom cylinders 19 of the boom sub-circuit 66. This automatic correction in the hydraulic fluid flow compensates for the hydraulic fluid flow stealing that occurs under operations in the first condition.

In step 206, controller 110 has already determined that the work vehicle is not operating in the first condition, and subsequently or simultaneously determines whether the work vehicle 10 is operating in the second condition (i.e., the boom assembly is retracting and the implement is curling). If controller 110 determines that the work vehicle 10 is operating in the second condition, then the method moves on to step 208; otherwise, the method moves on to step 210.

In step 208, the controller 110 accesses and retrieves information from the look-up table stored in memory storage device 111 and uses this information to modify the calculation and generation of output control signals sent to operate boom valve 76 so as to reduce the flow of hydraulic fluid to the boom cylinders 19 of the boom sub-circuit 66. The look-up table lists PWM duty factors that adjust, or down regulate, the output control signals to the boom valve 76, wherein hydraulic fluid flow to the boom assembly 17 is proportional to the PWM duty factor applied to the boom valve 76. In this manner, more hydraulic fluid flow is made available to the implement cylinders 18 of the implement sub-circuit 64. This automatic correction in the hydraulic fluid flow compensates for the hydraulic fluid flow stealing that occurs under operations in the second condition.

In step 210, controller 110 has already determined that the work vehicle is not operating in either the first condition or the second condition, and subsequently or simultaneously determines whether the work vehicle 10 is operating in the third condition (i.e., the boom arm assembly is extending while the implement is curling, or the boom arm assembly is retracting while the implement is dumping, or the boom arm assembly is in motion while the implement is not activated). If controller 110 determines that the work vehicle 10 is operating in the third condition, then the method moves on to step 212; otherwise, the method moves on to step 214.

In step 212, the controller 110 calculates and generates output control signals that are sent to operate boom valve 76 so as to make available the total flow of hydraulic fluid from conduit C5 to the boom cylinders 19 of the boom sub-circuit 66. Controller 110 performs this step without referencing the look-up tables in memory storage device 111; therefore, the corresponding output control signals are "not modified" as they are in steps 204 and 208. In this manner, the total hydraulic fluid flow from conduit C5 is made available to the boom cylinders 19 of the boom sub-circuit 66; however, as there is sufficient hydraulic fluid flow in conduit C5 to simultaneously supply both parallel sub-circuits 64 and 66 the problem of hydraulic fluid stealing is ignorable.

In step 214, controller 110 has already determined that the work vehicle is not operating in either the first condition, the second condition or the third condition, and subsequently or simultaneously determines whether the work vehicle 10 is operating in the fourth condition (i.e., the implement of the implement assembly is in motion while the boom arm assembly is not in motion). If controller 110 determines that the work vehicle 10 is operating in the fourth condition, then the method: moves on to step 216; otherwise, the method moves on to step 218.

In step 216, the controller 110 calculates and generates output control signals that are sent to operate implement valve 74 so as to make available the total flow of hydraulic fluid from conduit C5 to the implement cylinders 18 of the implement sub-circuit 64. Controller 110 performs this step without referencing the look-up tables in memory storage device 111; therefore, the corresponding output control signals are "not modified" as they are in steps 204 and 208. In this manner, the total hydraulic fluid flow is made available to the implement cylinders 18 of the implement sub-circuit 64; however, as there is sufficient hydraulic fluid flow in conduit C5 to supply sub-circuit 64 while sub-circuit 66 is in a stationary state, the problem of hydraulic fluid stealing does not exist.

Step 218 is a reiterative step wherein the method cycles back to step 202. In the method, steps 204, 208, 212, 214 and 216 all move to step 218, wherein some time period has elapsed and the controller 110 is awaiting or receiving the next sensor input from the control and position sensors of the enabled pair of manual controls. This new sensor input corresponds to the displacement of the enabled manual controls from the neutral position at some time period following the previous performance of step 202. In this manner the method recycles through the steps and the hydraulic fluid in conduit CS gets optimally shared between the sub-circuit 66 activating the boom arm assembly 17 and the sub-circuit 64 activating the implement 16 thereby ensuring proper and expected simultaneous movement by both of these components of the work vehicle 10 as they move throughout all possible movement conditions and ranges of motion.

The machine and method embodiments in accordance with the present invention have been fully disclosed and adequately described. It is reemphasized that because of the nature of the resistances in the hydraulic path of the common hydraulic circuit 50, and because of the force of gravity assisting or opposing motion, hydraulic flow sharing to compensate for hydraulic flow stealing between parallel hydraulic sub-circuits 64 and 66 is necessary only during operation of the work vehicle in the first condition or the second condition. Furthermore, the look-up table used in the method embodiment and stored in the memory storage device 111 of the machine embodiment in accordance with the present invention is determined empirically and is prone to include different PWM duty factor values depending upon the particular size and structure of the implement and the boom arm assembly of the specific type of work vehicle (e.g., make and model) in question. However, it is within the skill of one of ordinary skill in the art to empirically determine the values of the look-up table and store it in the memory storage device in a manner retrievable by the controller of the work vehicle.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

What is claimed is:

1. A work vehicle comprising:

a frame;

a boom arm assembly connected at one end to the frame;

an implement assembly pivotally connected to another end of the boom arm assembly, wherein the implement assembly includes an implement;

a first hydraulic implement cylinder connected to the implement assembly and positioned to pivotally rotate the implement relative to the boom arm assembly when a piston of the first hydraulic implement cylinder is extended or retracted, wherein the first hydraulic implement cylinder is connected to a first electrohydraulic valve that activates extension and retraction of the piston of the first implement cylinder by directing hydraulic fluid to the first implement cylinder;

a second hydraulic boom cylinder connected to the boom arm assembly and positioned to move the boom arm assembly between a first retracted position and a second extended position when a piston of the second boom cylinder is retracted and extended, respectively, wherein the second hydraulic boom cylinder is connected to a second electrohydraulic valve that activates extension and retraction of the piston of the second hydraulic cylinder by directing hydraulic fluid to the second boom cylinder;

a common hydraulic circuit connected to provide hydraulic fluid to the first electrohydraulic valve and to the second electrohydraulic valve, wherein the first electrohydraulic valve is connected in parallel with the second electrohydraulic valve in the common hydraulic circuit; and a controller connected to receive first input signals from a boom manual control sensor and second input signals from an implement manual control sensor, wherein the controller sends a first control signal to activate the first electrohydraulic valve in response to receiving a first input signal and the controller sends a second control signal to activate the second electrohydraulic valve in response to receiving a second input signal, wherein the controller is programmed to modify at least one of the first control signal and the second control signal in accordance with a table-based duty factor when the boom assembly and the implement are operated in a selected condition.

2. A work vehicle as recited in claim 1, wherein the first control signal is modified when the selected condition corresponds to dumping the implement while extending the boom arm assembly, wherein the modified first control signal effects a relative reduction in the hydraulic fluid flow from the first electrohydraulic valve to the first implement cylinder.

3. A work vehicle as recited in claim 1, wherein the second control signal is modified when the selected condition corresponds to curling the implement while retracting the boom arm assembly, wherein the modified second control signal effects a relative reduction in the hydraulic fluid flow from the second electrohydraulic valve to the second boom cylinder.

4. A work vehicle as recited in claim 2, wherein the second control signal is modified when the selected condition corresponds to curling the implement while retracting the boom arm assembly, wherein the modified second control signal effects a relative reduction in the hydraulic fluid flow from the second electrohydraulic valve to the second boom cylinder.

5. A method of sharing hydraulic fluid for activating a boom arm assembly and an implement, comprising the steps of:

inputting a first input signal from a first manual control sensor and a second input signal from a second manual control sensor to a controller connected to receive the first input signal and the second input signal;

sending a first control signal to control activation of a first electrohydraulic valve in response to inputting the first input signal into the controller;

sending a second control signal to control activation of a second electrohydraulic valve in response to inputting the second input signal into the controller, wherein activation of the first electrohydraulic valve directs hydraulic fluid flow through a first hydraulic sub-circuit and activation of the second electrohydraulic valve directs hydraulic fluid flow through a second hydraulic sub-circuit connected in parallel with the first hydraulic sub-circuit, and wherein hydraulic fluid flow through the first hydraulic sub-circuit effects movement of a boom arm assembly and hydraulic fluid flow through the second hydraulic sub-circuit effects movement of an implement;

determining whether the boom arm assembly and the implement are in a first condition, a second condition, a third condition or a fourth condition using the first input signal and the second input signal;

modifying at least one of the first control signal and the second control signal when the boom arm assembly and the implement are in the first condition or the second condition; and controlling activation of the first electrohydraulic valve using the first control signal or a modified first control signal and controlling the activation of the second electrohydraulic valve using the second control signal or a modified second control signal, wherein the modified first control signal activates the first electrohydraulic valve to effect a relative reduction in hydraulic fluid flow through the first hydraulic sub-circuit and the modified second control signal activates the second electrohydraulic valve to effect a relative reduction in hydraulic fluid flow through the second hydraulic sub-circuit.

6. A method of sharing hydraulic fluid for activating a boom arm assembly and an implement as recited in claim 5, wherein the first control signal is modified when the first condition corresponds to dumping the implement while extending the boom arm assembly, wherein the modified first control signal effects a relative reduction in hydraulic fluid flow from the first electrohydraulic valve to a first implement cylinder.

7. A method of sharing hydraulic fluid for activating a boom arm assembly and an implement as recited in claim 5, wherein the second control signal is modified when the second condition corresponds to curling the implement while retracting the boom arm assembly, wherein the modified second control signal effects a relative reduction in hydraulic fluid flow from the second electrohydraulic valve to a second boom cylinder.

8. A method of sharing hydraulic fluid for activating a boom arm assembly and an implement as recited in claim 6, wherein the second control signal is modified when the second condition corresponds to curling the implement while retracting the boom arm assembly, wherein the modified second control signal effects a relative reduction in hydraulic fluid flow from the second electrohydraulic valve to a second boom cylinder.

* * * * *